US008022286B2

(12) United States Patent
Neubäcker

(10) Patent No.: US 8,022,286 B2
(45) Date of Patent: Sep. 20, 2011

(54) SOUND-OBJECT ORIENTED ANALYSIS AND NOTE-OBJECT ORIENTED PROCESSING OF POLYPHONIC SOUND RECORDINGS

(76) Inventor: Peter Neubäcker, Munich (DE)

( * ) Notice: Subject to any disclaimer, the term of this patent is extended or adjusted under 35 U.S.C. 154(b) by 102 days.

(21) Appl. No.: 12/398,707

(22) Filed: Mar. 5, 2009

(65) Prior Publication Data

US 2009/0241758 A1 Oct. 1, 2009

(30) Foreign Application Priority Data

Mar. 7, 2008 (DE) ..... 10 2008 013 172

(51) Int. Cl.
*G04B 13/00* (2006.01)

(52) U.S. Cl. ..... 84/609; 84/604; 84/608; 84/622; 84/623; 84/649; 84/659

(58) Field of Classification Search ..... None
See application file for complete search history.

(56) References Cited

U.S. PATENT DOCUMENTS

| | | | | |
|---|---|---|---|---|
| 5,536,902 | A * | 7/1996 | Serra et al. | 84/623 |
| 5,698,807 | A * | 12/1997 | Massie et al. | 84/661 |
| 5,792,971 | A | 8/1998 | Timis et al. | |
| 5,886,276 | A * | 3/1999 | Levine et al. | 84/603 |
| 6,057,502 | A | 5/2000 | Fujishima | |
| 6,140,568 | A * | 10/2000 | Kohler | 84/616 |
| 6,323,412 | B1 * | 11/2001 | Loo | 84/636 |
| 6,836,761 | B1 * | 12/2004 | Kawashima et al. | 704/258 |
| 6,951,977 | B1 * | 10/2005 | Streitenberger et al. | 84/626 |
| 7,276,656 | B2 * | 10/2007 | Wang | 84/612 |
| 7,598,447 | B2 * | 10/2009 | Walker et al. | 84/616 |
| 2005/0217461 | A1 * | 10/2005 | Wang | 84/608 |
| 2006/0075881 | A1 * | 4/2006 | Streitenberger et al. | 84/609 |
| 2006/0075884 | A1 * | 4/2006 | Streitenberger et al. | 84/616 |

(Continued)

FOREIGN PATENT DOCUMENTS

DE 69614938 T2 4/2002

(Continued)

OTHER PUBLICATIONS

Every, M. et al.; "Separation of Synchronous Pitched Notes by Spectral Filtering of Harmonics"; IEEE Transactions on Audio, Speech and Language Processing, IEEE USA, vol. 14, No. 5; Sep. 2006; pp. 1845-1856; XP002533838.

(Continued)

*Primary Examiner* — Marlo Fletcher
(74) *Attorney, Agent, or Firm* — Rankin, Hill & Clark LLP

(57) ABSTRACT

A method of sound-object oriented analysis and of note-object oriented processing a polyphonic digitized sound recording present in the form of a time signal F(A, t) includes the following analytical and processing steps: portion-wise readouts of the time signal F(A, t) using a window function and overlapping windows; Fourier-transforming the readout signal into frequency space, in particular by applying a discrete Fourier transform; calculating an energy value E at each bin from the frequency amplitude resulting from the Fourier transformation, in particular by squaring the real and imaginary parts or forming energy values derived from them; generating a function F(t, f, E); identifying event objects; identifying event objects; identifying note objects; comparing the temporal occurrence of event objects and note objects and associating event objects to note objects in the case of plausible time occurrences; calculating spectral proportion factors for each note object.

31 Claims, 4 Drawing Sheets

U.S. PATENT DOCUMENTS

| | | | | |
|---|---|---|---|---|
| 2009/0282966 | A1* | 11/2009 | Walker et al. | 84/616 |
| 2010/0000395 | A1* | 1/2010 | Walker et al. | 84/616 |

FOREIGN PATENT DOCUMENTS

| | | | |
|---|---|---|---|
| DE | 102004049477 | A1 | 4/2006 |
| EP | 0750776 | B1 | 1/1997 |
| WO | 02/084641 | A1 | 10/2002 |
| WO | 2007/119221 | A2 | 10/2007 |

OTHER PUBLICATIONS

Gribonval, R. et al.; "Harmonic Decomposition of Audio Signals With Matching Pursuit"; IEEE Transactions on Signal Processing, IEEE Service Center, New York, New York; vol. 51, No. 1; Jan. 1, 2003; pp. 101-111; XP011080322.

Duxbury, C. et al.; "An Efficient Two-Stage Implementation of Harmonic Matching Pursuit"; EUSIPCO 2004, [Online]; URL:http://www.eurasip.org/Proceedings/Eusipco/Eusipco2004/defevent/papers/cr1814.pdf; pp. 2271-2274; XP002533839.

Klapuri, A.; Multiple Fundamental Frequency Estimation Based on Harmonicity and Spectral Smoothness; IEEE Transactions on Speech and Audio Processing, IEEE Service Center, New York, New York; vol. 11, No. 6; Nov. 1, 2003; pp. 804-816; XP011104552.

Virtanen, T. et al.; "Separation of Harmonic Sounds Using Linear Models for the Overtone Series"; 2002 IEEE International Conference on Acoustics, Speech, and Signal Processing; Proceedings; (ICASSP); Orlando, Florida; May 13-17, 2002; [IEEE International Conference on Acoustics, Speech, and Signal Processing (ICASSP)], New York, New York; vol. 2; May 13, 2002; pp. II-1757-II-1760; XP010804234.

* cited by examiner

SOUND-OBJECT ORIENTED ANALYSIS AND NOTE-OBJECT ORIENTED PROCESSING OF POLYPHONIC SOUND RECORDINGS

BACKGROUND OF THE INVENTION

1. Field of the Invention

The present invention concerns a method for sound-object oriented analysis and note-object oriented processing of polyphonic sound recordings.

2. Description of Related Art

It has long been known to subject acoustic recordings having a musical content to sound-quality post-processing. In earlier days such studio techniques were carried out resorting to expensive hardware equipment such as complex filter banks; nowadays on the other hand computers and special computer programs are used, which are far more economical and are accordingly more widespread. Further advances incorporate digital recording. In general the purpose of such post-processing is to improve the recordings' sound quality or to incorporate sound effects into them. Such sound post-processing operates in purely effect-oriented manner and might not detect the signal's musical content, instead construing the audio signals being merely a time-varying signal amplitude.

A method and equipment to change the sound and the pitch of audio signals are known in the state of the art, for instance from the European patent document EP 0 750 776 B1, respectively the German patent DE 696 14 938 T2. Such disclosures are considered as incurring the drawback that they preclude operating with complex sound materials such as occur in conventional musical productions.

Processing audio material is desirable at the level of the individual notes making up the sound recording. It is known from the state of the art to extract single notes with note pitches, note lengths and time of occurrence from an audio recording's. Such a note extraction illustratively is known from the German patent document DE 10 2004 049 477 A1 to determine a melody line of an audio signal. The transformation of an audio signal into a note-based description is known from the patent document WO 02/084641 A1, for the purpose of allowing reference of the audio signal in a databank. Processing the extracted notes, for instance by frequency changes or time shifts, does not take place. Said documents cite a further state of the art.

It is especially critical, when processing audio material, that the original sound perception, for instance of a singing voice, shall be preserved also following said processing. This feature is attained in an outstanding manner in the state of the art's "Melodyne" software made by Celemony Software GmbH, and it uses a note-based procedure. However this software presumes the material contains unison material. Chordal instruments such as guitars, pianos, or choral songs, heretofore could not be processed by means of tones. So far such chordal recordings could only be processed in chordal segments or by time stretching processed in time or in the note pitch, however without access to individual tones of a chord. It was impossible to change a single chord note (for instance the E of a C major chord illustratively into E minor for C flat) unless the other chord tones were simultaneously processed as well.

Chord recognition and approaches identifying individual notes are already known from the state of the art, though used to print notes (WIDI software) or to automatically recognize titles (German patent document DE 10 2004 049 477 A1).

BRIEF SUMMARY OF THE INVENTION

The objective of the present invention is to disclose a way for the successful note-object oriented processing of a polyphonic sound material.

In a first stage, the method of the present invention automatically identifies musical objects in the sense of notes in a recorded audio material. In a second stage, the objects are extracted tonally from the recording as a whole and thereby can be manipulated absent sensible loss or falsification of sound. This tonal extraction is not disclosed in the state of the art and it means that part of the total sound is associated with an identified note object. As a result, the original recording may even be freely altered musically in a way that the notes may change their relative position in pitch and in time while the initial sound perception however is preserved. The method of the present invention moreover provides that the identified note objects are made available to the user for processing. In this manner, the user may change individual or several musical objects, for instance as regards pitch. Following such user processing, sound reproduction, namely resynthesis, is carried out, namely the altered object, together with the unaltered objects, respectively with total signal less than the altered object, shall be reproduced. The initial material in this process already may be digitized or be an analogue signal. Digitization of any analog signal must take place before analysis.

The method of the present invention offers versatile applicability. For instance, particular musical errors may be deliberately eliminated: if a pianist did mistakenly one note too many, such note may be eliminated in post-processing. Another application relates to retuning, namely correcting an out of tune guitar or an inexact string movement. Tuned recordings may be transformed into a clean pitch. Recordings may be reharmonized, for instance a guitar's riff may be reharmonized from C major to F-minor. Heretofore a chord could only be shifted in tone level as a whole while the harmonic relations of its individual notes could not be changed. Due to the possibilities offered by the present invention, namely its access to the individual tones, even a new composition is feasible.

Predominantly, the method of the present invention relates to recorded individual tracks during music production. However, it also applies to mixed titles to make them into a new musical entity.

Previous technology allowed implementing the above only for monophonic sound material, that is to process illustratively singing or wind instrument sounds for which only one note of identifiable pitch will ring out. The method of the present invention allows single note processing of polyphonically played instruments, that is those where as a rule several notes or entire chords play out simultaneously, for instance pianos, guitars etc., where not only the chord as a whole is transposable (i.e., changing the pitch while preserving the pitch relations within a chord), but also and especially the notes within a chord sound may be altered relative to each other for instance changing a chord sound from major to minor.

The method of the present invention foremost applies to musical material already recorded, that is, not to "real time" analysis and processing at the time of the musical performance. Indeed, the method of the present invention assumes meaningful recognition of "notes" in the sense of secluded objects within a given context. While an analysis may be carried out in the background of a recording in process, the analysis must be applied to a time interval already past illustratively of about several seconds.

The method of the present invention is designed to detect individual pitches or pitch evolutions in the overall signal and to discriminate between them, not to separate individual sound sources. Its purpose therefore illustratively is not to distinguish between the individual sources of noise or voices that were recorded from street noises or from several speakers in a room. As a rule, two notes of equal pitch simultaneously played by two different instruments are identified as a single object, also the sound from many first violins in an orchestra playing the same note are construed as a single note. The concept of note object predominantly used herein emphasizes that the "notes" in the sense of the present invention are not meant as necessarily being the notes in the actual musical sense even though an identified note object of a note may, but does not mandatorily correspond to a note in the actual musical sense.

Unlike a piano note for instance, the notes to be detected need not have a pitch constant in time, but instead may experience an arbitrarily time-varying pitch such as in a singing voice with vibrato and/or portamento. When such pitch evolutions are consistent per se, the notes of the monitored signal remain detectable. In this way two tones crossing each other pitch-wise as time proceeds also may be identified as two different notes.

The method of the present invention essentially consists of two main procedures, namely a) identifying the individual objects contributing to the overall sound, that is the notes, possibly also the more eventful/percussion sound events, and b) sound resolution of the overall sound into the detected individual objects of which the sum results in the total sound, each object thereby being processable separately without thereby affecting by means of undesirable acoustic artifacts the sound of the remaining objects and of the total sound. The procedure b) of the present invention emphatically differs from the state of the art.

The outcome of the identifying procedure a) may also be used per se without resorting to the sound resolving procedure b) provided only detection and representation of the musical content be desired, the sound itself remaining unaltered. Such a situation may be advantageous when a musical notation shall be generated from an extant recording or when the musical content shall be shown graphically in another way. Or it may be used to ascertain and name the sequence of the musical harmonies in order to enrich the music with further instruments.

The quality of the result from the identifying procedure a) also affects the quality of the sound resolution of the procedure b). When, as mentioned above, the procedure a) merely serves to ascertain the musical content, in general it suffices to ascertain that a sound object arises at a given time, the object illustratively being at the pitch C sharp, and how long this object is active. If, on the other hand, the goal is the sound resolution of the procedure b), then advantageously as much data as possible should be analyzed relating to the evolutions and the parameters of the detected note objects, for instance the accurate evolution of the pitch curve depending on time, the amplitude of the object and its time function, the way a note is inserted, the consistency of the mixture of its pitches relative to notes of similar pitches in the same recording etc. Where desired, some data may be neglected.

As stated above, the principal property of the individual objects to be detected in the audio material is that their pitch, respectively their pitch sequence, be consistent on their evolution. Also their harmonics shall be consistent in their evolution. In other words, it is assumed that a music object to be detected consists of the evolution of a fundamental tone and of an unlimited number (in theory) of harmonics which approximately are integral multiples of the fundamental tone. Moreover the progress of the harmonics belonging to a sound object shall be devoid of non-deliberate discontinuities. These assumptions are based on the properties of the sounds generated by natural instruments. Consequently, the method of the present invention might encounter some bounds where synthetic music is produced arbitrarily.

The objects to be identified in the audio material and described above may be termed "sound-like" or "sound" objects and are termed "note objects" in the claims. The main property is to exhibit a pitch or a pitch evolution across a perceptible duration and that the curve of their time signal is substantially periodical or quasi-periodical. They are to distinguish from non-sound objects, that is from noise objects. Event objects are a sub-set of noise objects.

The event objects are characterized by exhibiting an impulsive rise in amplitude in their time signal and on that account already are aperiodic at that juncture. Moreover they usually decay rapidly. In musical terms, such events usually are generated by an abrupt event such as striking or plucking a string, or striking a percussion instrument such as a drum. In this respect they may be further distinguished from each other by the method of the present invention: when an event object immediately is followed by the amplitude rise of a sound object, it may be assumed that the event represents the striking of a note and therefore can be associated with this note. In that case the sound-like object and the event-like object may be combined to represent and manipulate a single object which also is denoted as being a note object. However as regards sound generation during resynthesis, that is in sound reproduction following processing one or more note objects, it may be appropriate to separately process the two partial objects on tonal grounds.

When the event-like object, hereafter event object, cannot be associated with a subsequent sound-like object, one may assume it is a note of purely perceived percussive-rhythmic nature, without pitch significance, for instance a drum beat. Such event object then may be dealt with differently in the ensuing processing.

The same as the event objects, the noise-like ones are devoid of a periodic sound component, while however being different in that they do not start abruptly nor do they decay rapidly, instead they may be of relatively long durations. Such components illustratively may be song consonants' hissing sounds, breathing noises, the player(s)' spurious contributions such as the fingers slipping on the guitar strings, or being background noises or interferences entirely unrelated to the actual music. Such noise-like objects illustratively may be made accessible to the user for further manipulation or they may be merely treated as a lumped "residual signal".

The method of the present invention is elucidated below by means of an illustrative embodiment and in relation to the appended Figures showing the results of individual method stages. This method was applied on a 6-second segment of a piano recording of the invention Nr. 1, C major by J. S. Bach.

DETAILED DESCRIPTION OF THE INVENTION

Figure 1:
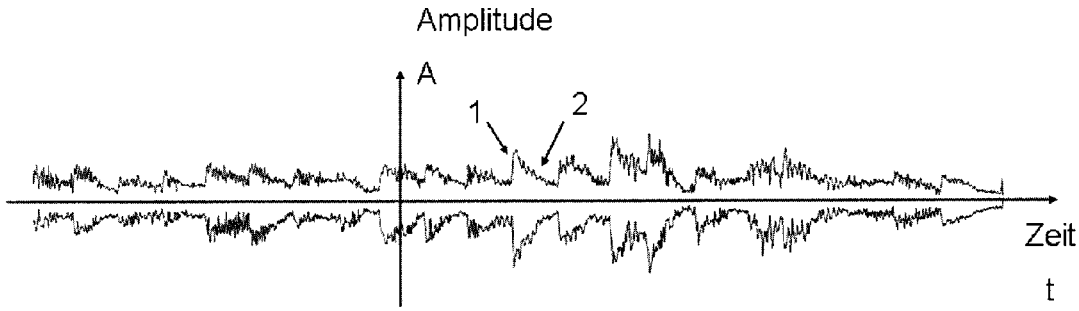
FIG. 1 shows the audio signal F(A,t) as an amplitude A relative to time t.

Concepts used to discuss the present invention will now be defined.

The terms "time domain" and "frequency domain" are the conventional ones and therefore relate to investigating or calculating either in the very initial time signal F(A,t) itself (=time domain) or its representation F(f,t) in the form (frequency domain) as obtained by means of a discrete Fourier transform, in particular a fast Fourier transform FFT.

"Window functions" are used to fade in or out a signal when processed at a time or frequency site. Accordingly they may relate to the time or the frequency spectrum. The shape of the window is not predetermined and in a simple case may be a triangle. A von-Hann window offers improved results. The window shape may be selected and optimised for the particular purpose. In the illustrative embodiment of the present method of the invention, the windows are overlapping.

"Bins" are those frequency bands resulting from using FFT's. When using instantaneous frequency method, such terminology also may apply to any altered band frequencies.

The instantaneous bin frequency is given by considering its phase. When the analyzing windows overlap it is possible to determine a bin's instantaneous frequency from the difference between the bin phase expected from its time development and its actual phase. The more widespread the overlap, the more the neighboring bins are able to represent a given frequency which need not agree with the calculated bin frequency.

Energy-like quantities denoted by E and hereafter termed "energy" and "magnitude" are calculated for the bins in the method of the present invention. After the FFT, one energy is associated to each bin, said energy being calculated from the real and imaginary components of the Fourier series as (Re*Re)+(Im*Im), resulting in a value correlated to the frequency amplitude. The magnitude is the related root. However to optimally scale the particular value in the analysis, the value of the magnitude where called for may be raised to an appropriate power between 1 and 2 as a result of which the quantity so obtained represents something between energy and magnitude. The concept of "energy" therefore is more general, not in the sense of acoustic energy or other known technical definitions of energy.

The "cent" used in relation to music is a measure of frequency ratios, that is defined as cent=log(f1/f2)/log(2)*1200. In this unit, a musical interval always is the same size regardless of its absolute pitch, namely halftone=100 cent, octave=1200 cent.

Metaphorically speaking, the discussed method of the present invention uses an energy landscape, meaning a 3D mathematical construct F(t,f,E) where the x-axis is the time t, the y axis is the frequency f and the z axis an energy E at the particular time/frequency point. The frequency axis uses the musical "cent" scale in order that the note intervals in each frequency domain always shall be equal. The energy landscape in the method further discussed below is represented by discrete points, the time axis by measurement points illustratively being 0.01 s apart, the frequency axis by points illustratively being 5 cents apart. In several procedural stages the discrete points are transformed by window functions into continuous spectrograms, though this feature is optional.

Following recording and analog into digital conversion, the audio material being investigated is in the form of a PCM (pulse code modulation, value and time discrete signal) audio file. The magnitudes cited in the text below, for example for analysing windows, relate to a digital signal with a sample rate of 44,100 samples/s. The magnitudes should be matched commensurately for other sampling rates.

Procedure a) Identifying Note Objects and Event Objects.

The illustrative procedure described below works both in analysis and in sound extraction for some partial goals directly in the time domain (FIGS. 1 and 2), for others in the frequency domain (FIGS. 3 through 7). Time-domain processing is more appropriate for event objects, frequency domain processing for sound objects. The search being carried out for discrete note objects in time, the signal is not processed continuously, instead a time interval is temporarily stored both in the time domain and in the frequency domain and then shall be investigated.

Figure 2:
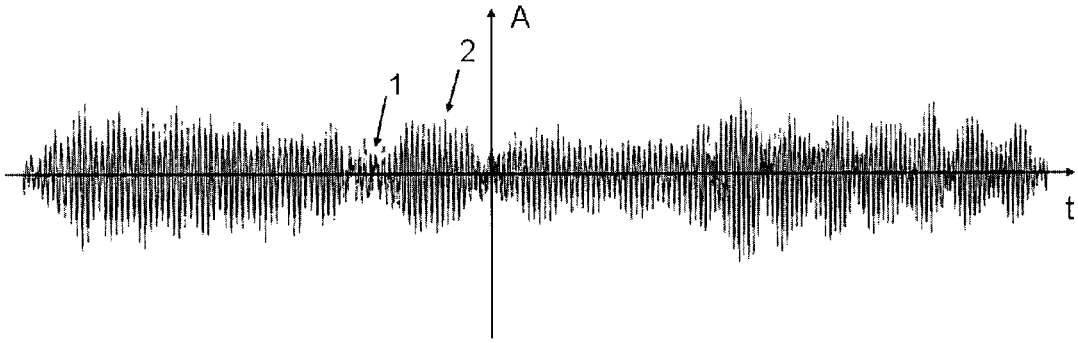
FIG. 2 is an enlarged time segment of FIG. 1 of a duration of 0.5 seconds.

FIG. 1 shows a signal function F(A, t) of an audio recording. FIG. 2 is an enlarged excerpt of FIG. 2. The reference 1 in these Figures denotes an event object which can be identified by an amplitude jump. The zone referenced by 2 on the other hand clearly shows higher periodicity.

To be processed in the frequency domain, the signal is read out by means of uniformly consecutive and overlapping window functions and initially is converted by FFT into a complex array relating to the particular time slice. The FFT magnitude illustratively may be 2,048 samples, the overlap shall be four-fold at a minimum. The resulting time slice separations illustratively are 512 samples or about 0.01 seconds.

Figure 3:
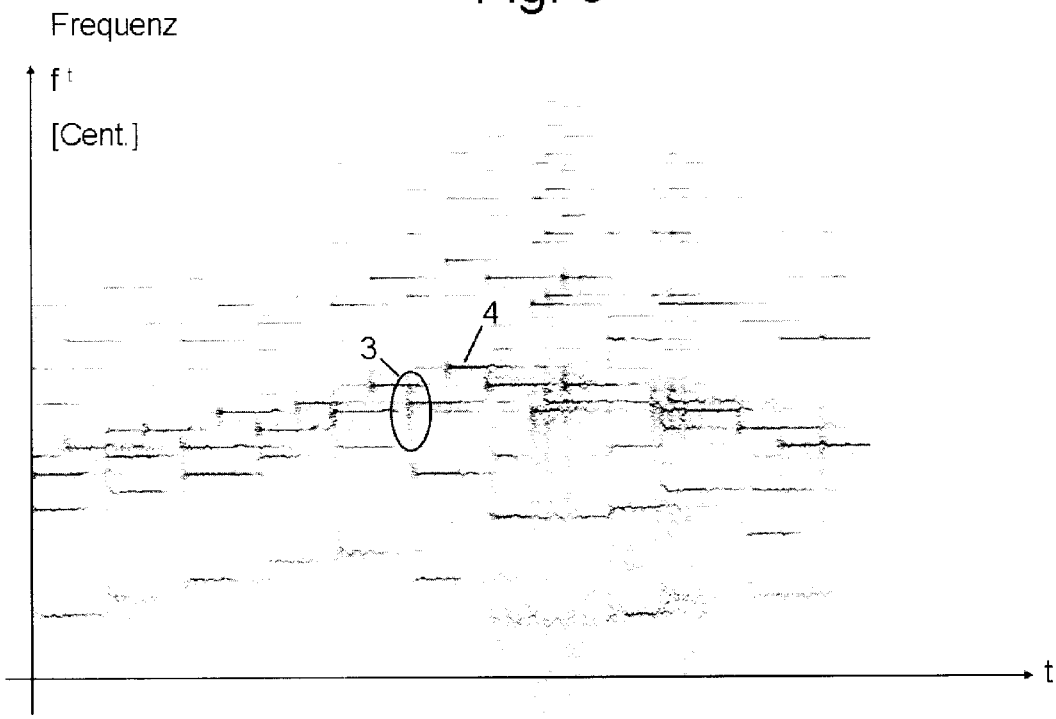
FIG. 3 shows the gray-tone coded energies of the individual bins at their instantaneous frequencies (after the audio signal of FIG. 1 was transformed into the frequency domain), the dark zones denoting high energies, the frequency f in cents relative to time t, namely F(f,t,E)

FIG. 3 shows one example of a further processed transformation result. It shows a function F(f, t, E) which results from the Fourier transformation of the time signal F(A, t) shown in FIGS. 1 and 2, by determining the bins' instantaneous frequencies and energies. The individual bins' energies are coded as gray tones and are plotted by their instantaneous frequencies in relation to time. Event objects 3 in this representation are characterized by the uniformly distributed instantaneous frequencies indicating the noisiness of this object. Note objects are characterized by the energy being concentrated into a few instantaneous frequencies. This difference is caused by the fact that a basically aperiodic signal function can only be adequately represented by the superposition of a large number of periodic functions, whereas periodic zones may be well represented using only a few periodic functions. Periodic zones in the time signal therefore entail an energy-concentrated superposition of adjacent bins 4 on a common instantaneous frequency.

The following values are determined in the frequency domain relating to the signal F(f,t,E): all bin magnitudes, all bin instantaneous frequencies, all bins' tonality values. The tonality value is a calculated magnitude representing the degree of periodicity in the bin frequency. Said tonality value is determined for each bin by ascertaining how closely the instantaneous frequencies of the neighboring bins come to that of the particular bin being considered. The number of neighboring bins considered equals the number of window overlaps because the latter determines how many bins may represent one frequency. A bin's tonality value is higher the closer the instantaneous frequencies of the bins in its vicinity are together. A high tonality value by trend implies the presence of a note object and a low tonality value by trend implies an event object. The tonality values are normalized to a range of values between 0 and 1. In addition a noisiness value is allocated to each bin, being directly derived from this tonality value and being calculated as being 1—tonality value. An abrupt rise of the noisiness value by trend implies an event object.

Figure 4:
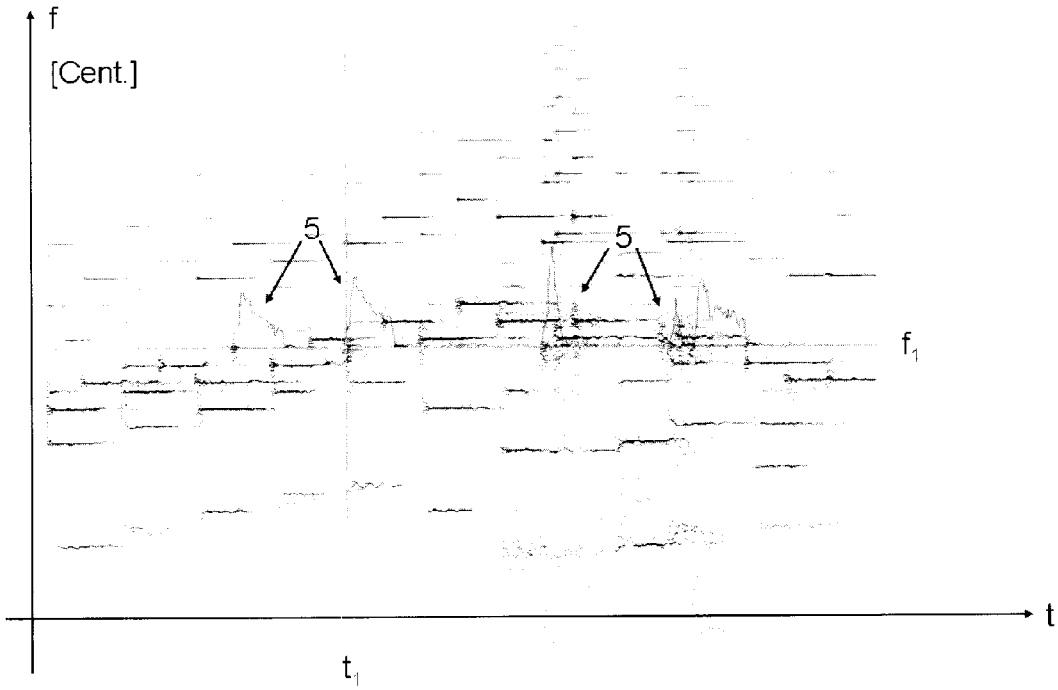
FIG. 4 is a plot of FIG. 3 with a section in the x and y directions and shows the computed energies E at the frequency $f_1$ at time $t_1$.
Figure 5:
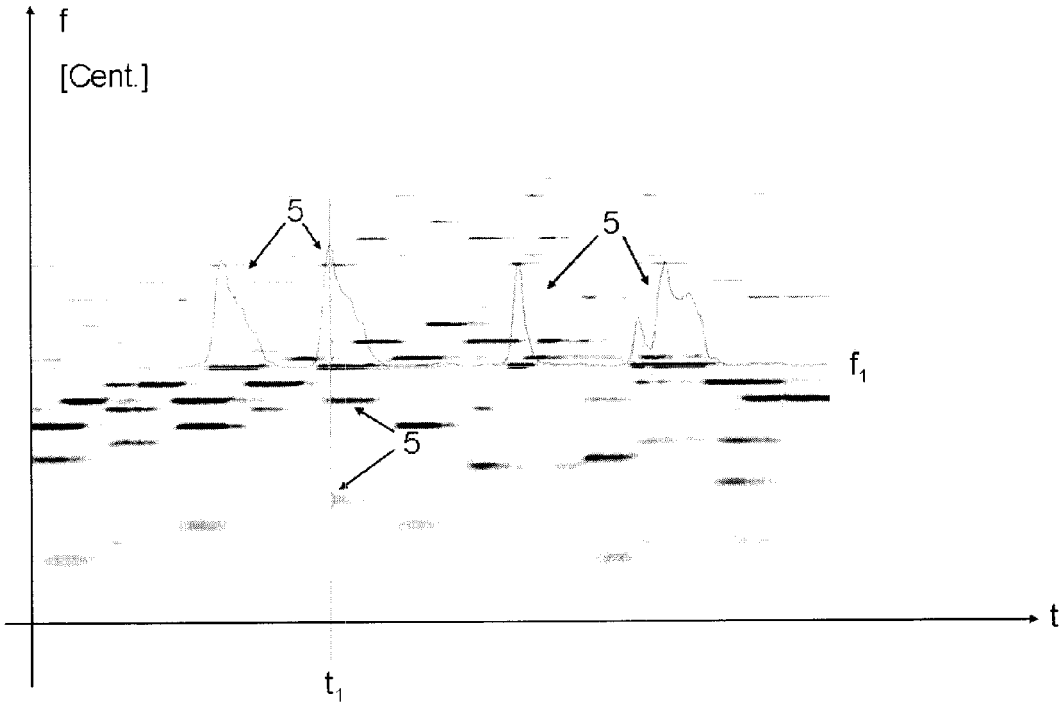
FIG. 5 shows an energy field F(f,t,E) similar to that of FIG. 4 where the energy values are summed by means of a window function and were smoothed in the direction of time, with a section in the x and y direction at the frequency $f_1$ and time $t_1$.

Thereupon an energy field is generated, which illustratively is shown in FIG. 4 in the form of a section along the time $t_1$ and the frequency $f_1$, the distribution of the energy E in time t and frequency f being represented by said field which is used to detect the note objects in the form of ranges of hills in this field. Smoothing in the direction of time may be carried out. A modified energy field preferably constructed from the energy field of FIG. 4 by a window function overlay is used for further calculations. In this case the smoothed function F(f, t, E) of FIG. 5 is obtained. Both Figures clearly show objects 5 associated with high energy values.

The method of the present invention initially seeking sound-like objects, the calculated bin energies are additionally weighted by the ascertained tonality values: the energy of each bin is multiplied by its tonality value for each time slice. Such weighting only gradually changes the result and therefore may optionally be dropped. According to the bin's instantaneous frequency, its cent position (=y position) is ascertained in the landscape and, based on that point, the product of energy and tonality value is summed for a given distribution width in the cent direction by means of a window function applied to the landscape. The cent width of the distribution window appropriately is of the order of a half tone. Such weighting by tonality values is the basis of FIG. 4. Once all time slices in the landscape have been summed, the landscape may be smoothed in the direction of time using a low-pass filter (FIG. 5). This feature facilitates finding related note objects as ranges of hills. The total landscape energy is summed and is available as the termination criterion for the ensuing iteration.

Note-object identification is carried out by iteration in a manner that each time the object most prominent in the sense of a maximal range of hills shall be considered and its energy then shall be subtracted from the landscape, then the next most prominent object shall be sought, and so on. The object of most prominent sound however is not identical with the highest range of hills in the energy landscape F(f,t,E). The reason is that a sound-like object is not defined by a single range of hills in the energy landscape, instead it must be assumed that the energies in ranges of hills belonging to the integral multiple of a fundamental frequency also belong to said searched-for sound-like object because being harmonics of the fundamental tone with the fundamental frequency. It may well be that the fundamental tone's energy is less than that of the harmonic tones, however the said object shall be looked for at its fundamental tone frequency and be monitored at it. These considerations are due to the fact that while the fundamental frequency does determine a tone's pitch, the tone's sound is substantially determined by the harmonics.

Figure 6:
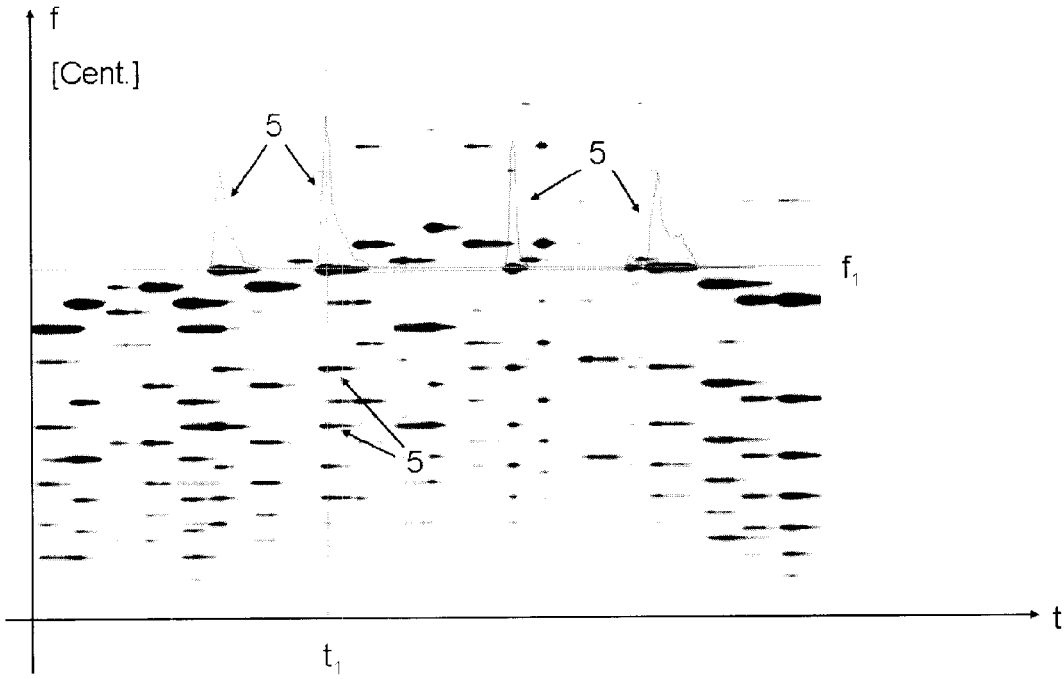
FIG. 6 shows a relevance field relating to the energy field of FIG. 5 with a section in the x and y direction with the first-detected maximum.

To account for the above facts, and metaphorically speaking, a second landscape is created, the so-called relevancy landscape illustratively shown in FIG. 6, of which the x and y axes and its size are identical with those of the energy landscape F(f,t,E), but its z values E' however being derived from said function: for that purpose and for each x-y coordinate point of the relevance landscape F'(f,t,E') the z value E' is formed as the sum of all z values E that are situated in the energy landscape F(f,t,E) at said x-y point and at all points corresponding to the whole-number frequency harmonics of the initial point. Appropriately, as the ordinal number of the harmonics increases, the particular energy value shall be added with decreasing weight. In this manner a relevance landscape F(f,t,E') is created that takes into account fundamental tones with their harmonics, of which the highest is the most sound-relevant point of the most relevant note. The relevance landscape F'(f,t,E') shown in FIG. 6 shows the same, energetically prominent objects 5. Compared with FIG. 5, a shift in the relative energy levels took place by taking into account said harmonics.

Detecting the note objects in the relevance landscape discussed above, which basically is only one special energy landscape, namely one that takes into account the harmonics' energy, is carried out by an iterating mathematical process. The discussion to follow elucidates how to detect the note objects in this particular relevance landscape without the invention being restricted to this particular implementing mode. In principle, the note objects also might be detected in one of the other energy landscapes described already above or being modified further, though in that case a drawback would be incurred, namely that harmonics would be identified as intrinsic notes and would have to be combined by post-processing with the fundamental tones. The problem of separating note objects by sound shall be well solved when the fundamental and the harmonics can be linked. This is the reason to prefer the maximum search in the relevance landscape, because it does lead to the best results.

First the highest point in the relevance landscape is looked for. The energy maximum shown in FIG. 6 was found at $t_1$ and $f_1$. The crest of the range of hills belonging to this maximum is monitored forward and backward in time. In the process, in the particular adjacent time slice, the landscape maximum as seen in the direction of the pitch nearest to the last detected point shall be looked for in said landscape. When the distance to the nearest maximum is so large that a continuation of the pitch line as the same object is implausible, for instance in the presence of a jump of more than 50 cents from one time slice to the next, the search in the same direction shall be abandoned. The search also shall be abandoned when failing to attain a particular rise of detected maximum, for instance 10% of the initial value. Appropriately, the monitoring of the range of hills takes place in the relevance landscape because its evolution better corresponds to the pitch evolution of the looked-for object on account of the partial tones contributing to weighting. When the search has been abandoned in both directions, a new note object will be generated and all points of the detected crest are added to it as its pitch evolution. In this respect the claims state that a field of values belonging to the maximum has been ascertained. This field of values may be ascertained otherwise than discussed above, for instance other mathematical processes being used. Illustratively, the field of values may be interrogated point after point in all directions away from the maximum until dropping in all directions below a threshold value. All points above the threshold would be allocated to the maximum as a field of values.

Next, the computational energy of the detected note object is removed from the energy landscape F(f,t,E), namely at the sites of its fundamental as well as that of all harmonics, i.e. the whole number multiple of the fundamental sound frequency. In principle, this process also might be carried out in the relevance landscape F'(f,t,E'), though at the cost of some degradation, because the superposition of harmonic tones belonging to different fundamental tones is more effectively eliminated when the energy removal takes place from the energy landscape.

Advantageously, however, not all the above energy shall be withdrawn, only a given portion, for instance 50%. The user may set such a portion for instance as a parameter at other values, as other portions depending on the audio material may offer better results. In the event of a large harmonics superposition, a lowering to 25% for instance might lead to better results. Withdrawing only part of said energy makes sense because it is unknown initially whether simultaneously audible note objects comprise harmonics near those of the initially detected note object. Further note objects may only be found in the subsequent iterations when the energy is withdrawn partly.

Advantageously, the energy reduction at the given frequency sites in the energy landscape E(f,t,E) again takes the form of an upward and downward fade-out window function of a width of about a halftone. When a model of the harmonics spectrum of the sound is known, for instance because a reference spectrum is available, or can be modeled, of the instrument generating said sound, the harmonics energy withdrawal can be correspondingly carried out in said reference spectrum or model. The note object "remembers" the energy portion it withdraws for ulterior evaluation because said energy portion was written into it.

The relevance landscape is recalculated—as already more comprehensively discussed above—in the time domain affected by the newly found note object, because, in said time domain, the energy landscape being the basis of the relevance landscape was changed by the withdrawal of the energy.

A check is run on the newly found note object whether it intersects, in time and by its fundamental frequency, another previously detected note object. If it intersects the prior note object, or adjoins it directly, in such a manner that there is plausibility it is one and the same, it will be credited to the former (possibly while broadening the pitch evolution). Otherwise it shall be incorporated in the quantity of detected note objects as a new one. Only illustratively 50% of the note object being withdrawn in each iterating stage, each note object in general will be found several times in the course of iteration.

The iteration continues by again seeking the highest point in the changed relevance landscape. Said iteration goes on until reaching a termination criterion. An advantageous iteration termination criterion is the energy reduction relative to the initial energy in the energy landscape. Illustratively, the iteration may be terminated when only 10% of the initial energy remains in the energy landscape. This criterion too may be varied by the user.

The detection of event objects characterized by an abrupt rise of the noise portion of the signal may be carried out either in the time domain signal, foremost the rise of all high-pass filtered signal portion being monitored, or in the frequency domain using the bins' noisiness values which, for that purpose, are summed while weighted with the particular bin energies, for each time slice. In both cases the evolution curve is obtained of the noise portion of the total signal. At the steepest rises of this curve, which may be defined by an associated threshold value, event objects have to be presumed.

Figure 7:
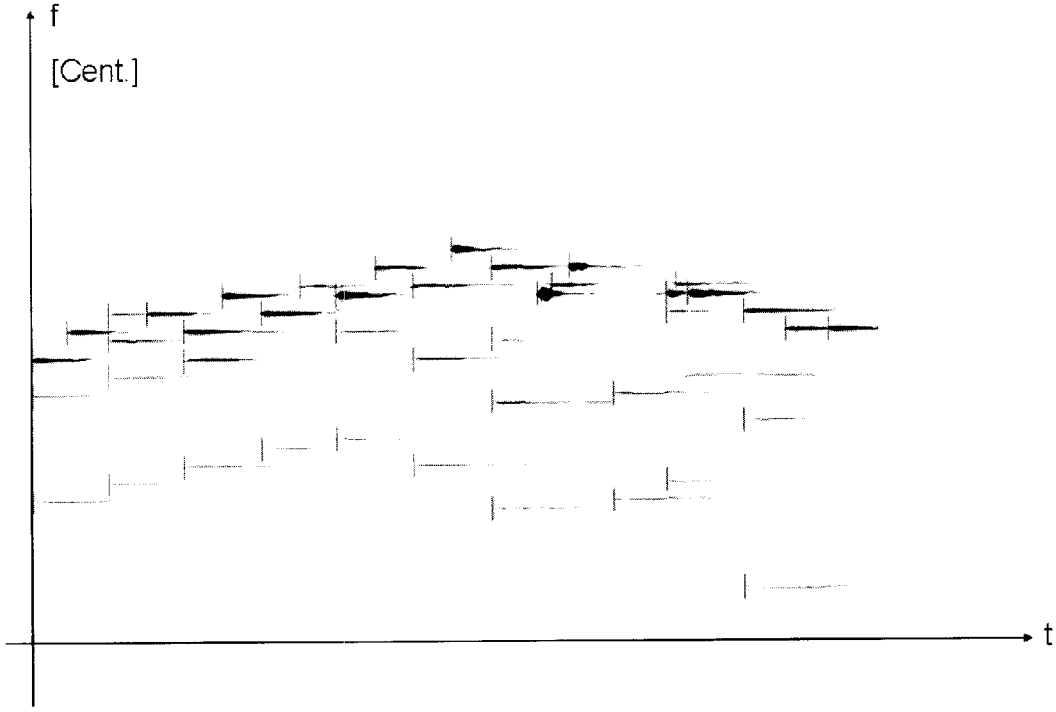
FIG. 7 shows all detected note objects upon termination of iterated identification.

The event objects found in the previous stage may arise whether isolated per se in the signal, as is the case for purely percussive events, or being strike noises of the note objects previously found when iterating, as is the case for plucked or struck tonal instruments such as guitars, pianos etc. To discriminate between them, a test is run for each event object when detected to determine whether immediately after said event a significant increase in their energy took place at one or more of the note objects situated there. If so, the event object shall be construed as striking the note object and will be associated with it. If the rise in energy takes place at several notes, the event object is associated with all these notes. If the rise in energy occurs in the middle of a note object, the note object will be separated at that site and henceforth be construed as a new note object. If no corresponding note object was found at the time of the event object, this event object is construed being percussive. FIG. 7 shows the note objects detected in the present embodiment together with event objects denoted by perpendicular dashes that could be associated with these note objects.

Advantageously, a rating stage should precede the detection of the note objects. When searching note objects using the above described iteration, more objects shall be found in general than are musically plausibly present. Therefore, the found note objects in the end are tested against various plausibility criteria and any note objects of low plausibility are removed. Illustratively one plausibility criterion is the relative energy and the masking. In general, as regards the above described iteration, too many small note objects having too little energy will be found. Therefore a check is run in the time domain on the note's energy relative to the total energy. If said note's relative energy is too low, it may be removed.

Occasionally objects are identified as notes per se which are actually the harmonics of another existing note. In that case a check may be run whether the higher note evinces its own pitch evolution, amplitude and duration, or whether it acts in such parameters as a lower note. If the latter is the case, the object may be removed, or be added to the lower note.

Further evaluations may be carried out based on musical perceptions. If, for instance, a note object is highly isolated in its pitch vicinity (very high or very low if absent other notes) it is musically unlikely. If, for instance, a note is linked to other notes as regards vicinity in pitch and time to constitute a rising or falling line, it is musically speaking highly likely, even if otherwise being rather weak, etc. All these criteria can be represented mathematically and for instance be weighted in order to arrive at a number of note objects which is as plausible as possible.

The above identification process may also be followed by user intervention when this user sees the detected note objects in a graphically appropriate manner for instance as in FIG. 7 or is able, in mouse-controlled or menu-controlled manner, to resolve objects identified as a note or to combine separate notes into one object. Obviously too, the user may erase individual notes or add further objects to be taken into account. Also, he may have the choice to activate objects that were assessed being of low relevance in the previous automated analysis.

The automated identification optionally may be optimized by storing the recorded music piece's notes, whereby, in the above cited method, detection uses the stored notes to locate the fundamental tones corresponding to the frequencies of the backed up notes. This may be implemented, for instance, by analyzing a stored MIDI file containing the notes of the recorded composition. Alternatively and simultaneously with recording the actually used total signal, support tracks may be recorded for instance by fitting the instrumentalists or singers with their own microphones, or recording the individual strings of a guitar. In such a predominantly monophonic signal of the individual voices, the desired notes of the total signal may then be identified more unambiguously and hence the total sound may be better resolved for processing.

Procedure b) Sound Assignment to Note Objects.

After identifying the individual objects participating in the total sound, sound resolution of this total sound can be carried out in a subsequent stage. The more accurately the note objects, their pitch and amplitude evolutions and the way they are applied, the more accurately they represent a parameter affecting the sound resolution quality. In the sound resolution described below, the total sound is resolved only into as many individual sound objects as are required for resynthesis of the total sound. If, for instance, in a detected complex chord the user retrieved only a single note of which the pitch shall be changed, then the signal from this note need only be extracted and subtracted from the original signal. Accordingly the more single signals shall be generated, the more notes will be changed. Each signal then is monophonic and periodic and may be summed and played using already known procedures used for a reproduction which is both time and pitch independent.

In a first sound resolution stage, the event objects are extracted from the original signal. When the original signal is resolved into individual signals belonging to the particular note objects, the subdivision of the frequency spectrum entails—to begin with—blurring the event sites in the time signal. Appropriately, therefore, the event object sites are first separated from the time signal and then to carry out note object resolution on the residual signal so produced. This optional method stage also may be omitted.

A modified time signal from which the sound portions have been removed as completely as possible is generated to separate the event object. For that purpose, the magnitudes of all bins are multiplied by the bins' noise values in the frequency domain and a time signal is generated, using the new magnitudes and the original phases, by means of the FFT. Optionally the magnitude factors also include damping factors for the low signal portions because frequently the higher portions often are more relevant for the event objects. The time signal of the event objects are separated by means of an appropriate window function from said new noisy time signal at those sites where, in the identifying stage elucidated above, event objects had been found, said window function illustratively exhibiting a short rise time of about 0.005 s and a decay time of about 0.05 s. These short time signals of the event objects are deducted from the original time signal and illustratively are stored separately.

Next, there is a separation of the note objects from the original signal. The sub-division of the original signal (less the removed event portions) into the individual sounds of the objects takes place in the frequency domain. For that purpose the original signal following its modification (see above for event object separation) shall first be newly transformed into the frequency domain.

The note-object subdivision into the individual sounds is based on each note object in each time slice announcing a "demand" on a spectral portion of the entire signal F(f,t,E). Said demand is represented mathematically by spectral portion factors that for each note object are calculated from a spectral portion function which illustratively is obtained from a sound model of a single note. Said model may be merely predetermined or it may imitate the real sound of an instrument when it is known to which instrument the note object is related. In the present instance, the model is based on the following components: it is assumed there are whole-number harmonics of the note objects' fundamental frequency. It is assumed moreover that the amplitudes of the harmonics of a fundamental obey a harmonic's model. In the simplest case, this may be the amplitude decreasing with the reciprocal of the harmonic number. However the harmonics model may also represent the evolution of the harmonics' amplitudes resulting from empirical sound. Lastly, it is assumed that the harmonics' amplitudes are related ratio-wise to the evolution of the note object fundamental's energy. In the simplest case it is assumed that said harmonics' amplitudes are proportional to the fundamental's energy, though another relation also may be derived from an empiric sound.

From said assumptions, a spectral portion function is predetermined which illustratively may differ for different instruments, and the spectral portion factors are calculated for each note object in each time slice, that is the demands of said object on each bin.

When several portion functions are available, the user might employ one of them. However the selection also may be automated, for instance when the user enters (inputs) the instrument that played the note object, or when there is automated identification that said note object was played on a given instrument, the latter conclusion possibly being obtained from the fundamental amplitude ratios of a note object corresponding to a stored portion function.

The magnitude of the calculated portion factors depends on the frequencies and amplitudes of the harmonics determined, for instance, by the selected model of an individual note's sound. Also the portion factor magnitude depends on the proximity or distance of the harmonic's frequency to, respectively from, the particular bin's instantaneous frequency. The magnitude of the portion factors as a function of distance illustratively may be entered into a frequency domain weighting curve, said curve being wide enough to allow also slight deviations from the given frequency. On the other hand the weighting curve shall be so narrow in the central zone as to allow adequate separation of the harmonic portion factors from different simultaneously sounding notes with different fundamental tone amplitude and associating the harmonics with the right note. An appropriate weighting curve to assess the distance of the frequencies illustratively may be a von Hann window raised to the fourth power of which the full width corresponds, for instance, to two halftones.

Once within the particular time slice all note objects detected as sounds have announced their demands regarding the portion factors at all bins, the sum of the portion factors of all notes for each bin are normalized to 1. For each note object a time signal of its own with the duration of said object is then applied. For each time slice the magnitudes or another suitable energy value of all bins is then distributed according to the normalized portion factors to the note objects. These individual note object portions in the frequency range are transformed back with the original phases by means of FFT into the time domain and the time signals are accumulated on the individual note object time signals.

The magnitude portions and other energy portions having been changed previously, the signal ends no longer are faded out to 0 upon their retransformation into the time domain, which leads to undesirable artifacts. Accordingly, the result of the retransformation should be subjected again to a window function. Appropriately the root is taken of the values of actual window function and then the window is used before FFT and following inverse FFT.

Lastly, the note objects are combined with the event portions. As already discussed above, the event objects were associated with the note objects and that a time signal was generated for the event objects. Now this time signal can be added to the beginning of the note objects who were associated with event objects. When several note objects have been associated with one event object because of the assumption that they were struck simultaneously, then the even object's time signal will be distributed in its amplitude onto the associated note objects. Such a procedure may be appropriately carried out in relation to the note objects' energies per se or on the basis of the posited instrument model.

Event objects not associated with any note objects together with their extracted time signal may be made available as independent percussive objects.

When the time signal has been generated for all detected note objects and their associated event objects, then said time signals of all notes are deducted from the original signal. Because of the assumption of a sound model made for the sound subdivision, namely that the note objects substantially consist of harmonics which approximately are whole-number multiples of a fundamental, not the full sound and hence not the entire time signal shall be distributed on the individual objects. Therefore, after the time signals of all individual objects have been removed from the original signal, there is a residual signal containing the more noisier portions. This residual signal can be reproduced at resynthesis or it may be made available to the user, as a whole or resolved into further individual objects, for further processing.

The time sequence of the above cited individual method stages may also be selected otherwise. Illustratively, the event objects may be associated with the note objects only directly before resynthesis. This alternative also is available for other procedural stages such as the identification of the event or note objects or the calculation of portion factors.

The invention claimed is:

1. A method for sound-object oriented analysis and for note-object oriented processing of a polyphonic, digitized sound recording, which is present in the form of a time signal F(A, t), comprising:

creating a readout signal of the time signal F(A, t) using a window function and overlapping windows, carrying out a Fourier transformation of the readout signal into a frequency space, calculating from frequency amplitude, an energy value E for each bin, said amplitude resulting from the Fourier transformation, generating a three-dimensional function F(t, f, E) from the frequency amplitude, identifying event objects, said event objects exhibiting an impulsive rise in amplitude in their time signal and being substantially aperiodic, identifying note objects, said note objects exhibiting a pitch or a pitch evolution across a perceptible duration and having a substantially periodical or quasi-periodical curve in their time signal, comparing the occurrence in time of event objects and note objects and associating event objects with note objects in the case of plausible occurrences in time, calculating spectral proportion factors for each note object, associating signal portions of the frequency signal F(f, t, E) with detected note objects using the calculated proportion factors, performing an inverse transformation of the frequency signal portions associated with note objects into time signals, representing, graphically, the note objects and/or event objects as a time/frequency display on a monitor, processing, either via user control or automatically, one or more note objects, storing the time signals of processed note objects, and reproducing the stored time signals of processed note objects jointly with the time signal, which is reduced by a time signal associated with a note object.

2. The method as claimed in claim 1, wherein a function F'(t, f, E') is calculated from F(t, f, E), the energy values E' being the sum of all energy values E at a time t at a fundamental frequency f and all its multiples/harmonics.

3. The method as claimed in claim 2, wherein the energy values of the multiples/harmonics of the fundamental frequency are added following weighting by a factor differing from 1.

4. The method as claimed in claim 2, wherein the following method stages are carried out to identify the note objects:

ascertaining an energy maximum in the function F'(f, t, E'), ascertaining a field of values related to the maximum, and associating the ascertained field of values each time with a note object.

5. The method as claimed in claim 4, wherein the energy values E of the field of values associated with the note object is subtracted from the function F(t, f, E).

6. The method as claimed in claim 5, wherein the energy values E are subtracted only at the level G*E, where G is a factor such that 0<G<1.

7. The method as claimed in claim 6, wherein the factor G is a parameter that may be varied by user.

8. The method as claimed in claim 5, wherein the search for a maximum is continued on a function from which the energy values were deducted or on a function calculated therefrom.

9. The method as claimed in claim 4, wherein the search for a maximum is carried out iteratively until a termination criterion has been reached.

10. The method as claimed in claim 9, wherein a total energy value Etot relating to the function F(t, f, E) is calculated and the iteration is terminated as soon as a given proportion H*Etot of this total value has been associated with the detected note objects, when said proportion rises above 90%.

11. The method as claimed in claim 10, wherein the H factor is a user-variable parameter.

12. The method as claimed in claim 1, wherein an identified object during a subsequent automated purification shall be discarded in the presence of one or more of the following criteria:

the detected note object's energy is minute compared with the total energy, the evolution of pitch and amplitude of the note object substantially coincides with that of another note object of lower frequency, and there is a very large gap in frequency between one note object and the other note objects.

13. The method as claimed in claim 1, wherein, in a post-processing stage, a user separates, links and/or erases automatically identified note objects.

14. The method as claimed in claim 1, wherein for each bin, an instantaneous frequency is calculated from the phase difference of neighboring bins said instantaneous frequency being used as the bin frequency in the function F(t, f, E) or F'(t, f, E').

15. The method as claimed in claim 1, wherein a tonality value and/or noisiness value is calculated in each bin to detect the event objects.

16. The method as claimed in claim 15, wherein each bin energy value is weighted by the tonality value.

17. The method as claimed in claim 1, wherein the identification of note objects resorts to available/stored notes.

18. The method as claimed in claim 1, wherein the detected event objects are extracted from the time signal F(A, t) and the sound resolution is carried out on the residual signal.

19. The method as claimed in claim 18, wherein the event objects are stored separately.

20. The method as claimed in claim 1, wherein the spectral proportion factors of a note object are calculated from a stored/available proportion function.

21. The method as claimed in claim 20, wherein the stored/available spectral proportion function is the mathematical mapping of a note object's sound model, this model comprising one or more of the following postulates:

a fundamental tone with a fundamental frequency that is accompanied by spectral components at whole-number multiples of the said fundamental, namely harmonics at harmonic frequencies, the amplitude evolution of the harmonics of a fundamental obeys a law based on a harmonics model or an empirically determined harmonics amplitude evolution, and the harmonics' amplitudes are in a fixed relationship to the evolution of the fundamental's energy.

22. The method as claimed in claim 20, wherein the stored/available spectral proportion function is the mathematical mapping of the sound of a note played on a given instrument.

23. The method as claimed in claim 20, wherein several spectral proportion functions are stored/available in particular different proportion functions for several instruments.

24. The method as claimed in claim 23, wherein the user selects one of the several proportion functions.

25. The method as claimed in claim 23, wherein one of the several proportion functions is automatically associated to an note object upon input by a user or by automated action, upon detecting on which instrument the note was played.

26. The method as claimed in claim 20, wherein the spectral proportion function by means of a window function carries out weighting at a predetermined frequency width.

27. The method as claimed in claim 1, wherein a residual signal is calculated by subtracting all time signals associated with the note objects and with the event objects from the original time signal.

28. The method as claimed in claim 27, wherein the residual signal is subjected to a further identification of note or event objects.

29. The method as claimed in claim 1, wherein with respect to sound reproductions and following processing a note object, the sound portion of the note object is removed from the total sound and the differential signal produced in this manner shall be played jointly with the note object's sound portion.

30. The method as claimed in claim 27, wherein with respect to sound reproduction and following processing a note object by the user, the residual signal is jointly reproduced.

31. A computer program comprising a programming code to carry out the method claimed in claim 1 when the computer program is run on a computer.

* * * * *